US011369829B1

(12) United States Patent
Golamb

(10) Patent No.: US 11,369,829 B1
(45) Date of Patent: Jun. 28, 2022

(54) EXERCISE DEVICE

(71) Applicant: Edward Lamar Golamb, Mesa, AZ (US)

(72) Inventor: Edward Lamar Golamb, Mesa, AZ (US)

( * ) Notice: Subject to any disclaimer, the term of this patent is extended or adjusted under 35 U.S.C. 154(b) by 0 days.

(21) Appl. No.: 16/825,083

(22) Filed: Mar. 20, 2020

Related U.S. Application Data

(63) Continuation-in-part of application No. 29/695,287, filed on Jun. 18, 2019.

(60) Provisional application No. 62/874,616, filed on Jul. 16, 2019.

(51) Int. Cl.
*A63B 21/08* (2006.01)
*A63B 21/06* (2006.01)
*A63B 21/00* (2006.01)

(52) U.S. Cl.
CPC ..... *A63B 21/08* (2013.01); *A63B 21/0604* (2013.01); *A63B 21/4035* (2015.10); *A63B 21/4047* (2015.10)

(58) Field of Classification Search
CPC . A63B 21/0004; A63B 21/06; A63B 21/0601; A63B 21/0608; A63B 21/0615; A63B 21/0617; A63B 21/08; A63B 21/22; A63B 21/222; A63B 21/40; A63B 21/4023; A63B 21/4043; A63B 21/4047; A63B 21/4049
See application file for complete search history.

(56) References Cited

U.S. PATENT DOCUMENTS 1,973,593 A * 9/1934 Willner ..... A63B 21/4047 482/92
5,496,240 A * 3/1996 Damm ..... A63B 21/072 482/93
5,759,139 A * 6/1998 Wright ..... A63B 21/4047 482/121
5,827,157 A * 10/1998 Lee ..... A63B 21/06 482/93
8,177,692 B2 * 5/2012 Deppen ..... A63B 21/0728 434/226
8,974,354 B1 * 3/2015 Nelson ..... A63B 21/08 482/94
9,289,646 B2 * 3/2016 Tully ..... A63B 23/03525
9,808,663 B2 * 11/2017 Chen ..... A63B 23/03591
2018/0280753 A1 * 10/2018 Krull ..... A63B 21/025
2019/0060698 A1 * 2/2019 Sarazen ..... A63B 21/0618

* cited by examiner

*Primary Examiner* — Nyca T Nguyen
*Assistant Examiner* — Zachary T Moore
(74) *Attorney, Agent, or Firm* — Invention To Patent Services; Alex Hobson

(57) ABSTRACT

An exercise device has a yoke that is joined to a receiver. A detent pin joins a base washer to the yoke. Weights arranged above the base washer are used as a stabilizing support foundation while performing exercise.

2 Claims, 3 Drawing Sheets

EXERCISE DEVICE

RELATED APPLICATION

This application claims priority to provisional patent application U.S. Ser. No. 62/874,616 filed on Jul. 16, 2019 and to design patent application U.S. Ser. No. 29/695,287 filed on Jun. 20, 2019 the entire contents of both applications is herein incorporated by reference.

BACKGROUND

The embodiments herein relate generally to equipment that is useful for the exercise of humans.

Prior to embodiments of the disclosed invention exercise required a number of devices. One endeavor in this field is U.S. Pat. No. 8,974,354 issued to Nelson. Embodiments of the disclosed invention solve this problem.

SUMMARY

An exercise device has a yoke that is joined to a receiver. A detent pin joins a base washer to the yoke. Weights arranged above the base washer are used as a stabilizing support foundation while performing exercise.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
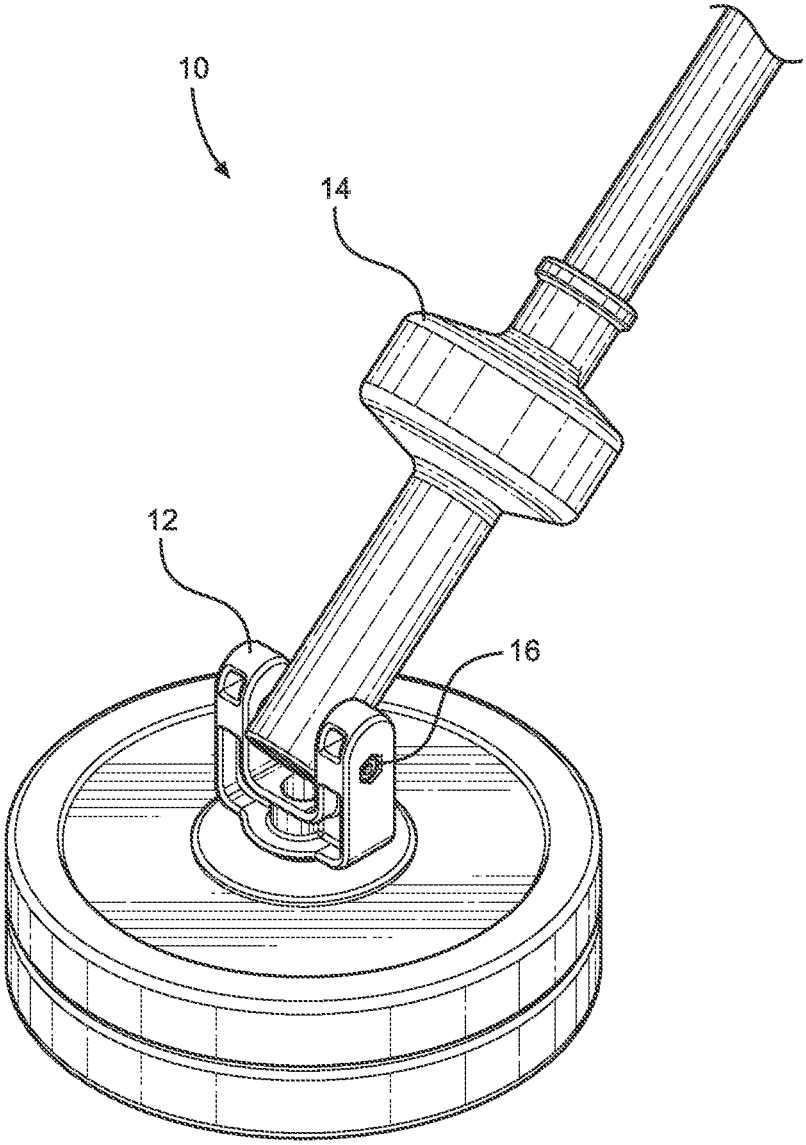
FIG. 1 shows a front perspective view of one embodiment of the present invention.
Figure 2:
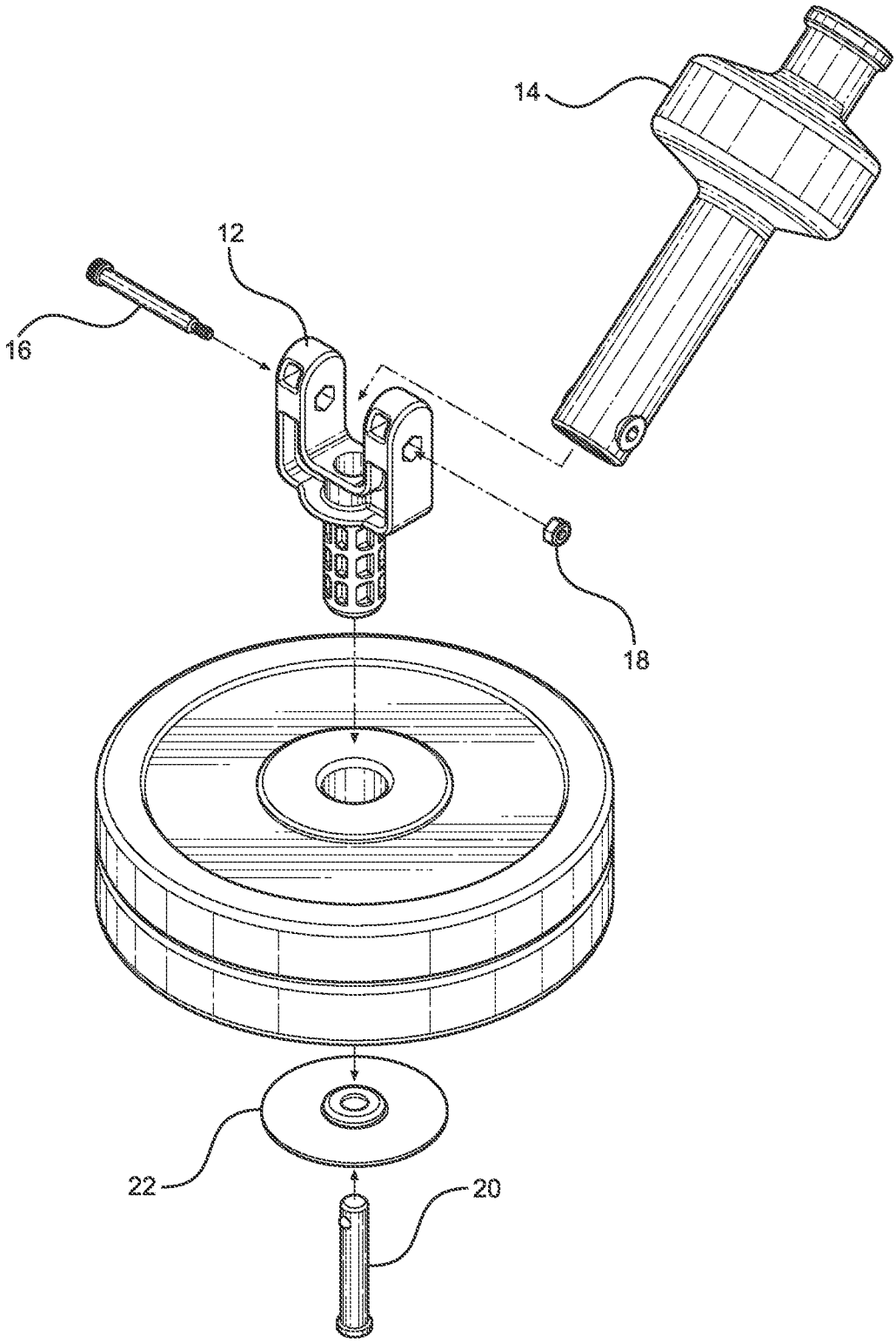
FIG. 2 shows an assembly view of one embodiment of the present invention.
Figure 3:
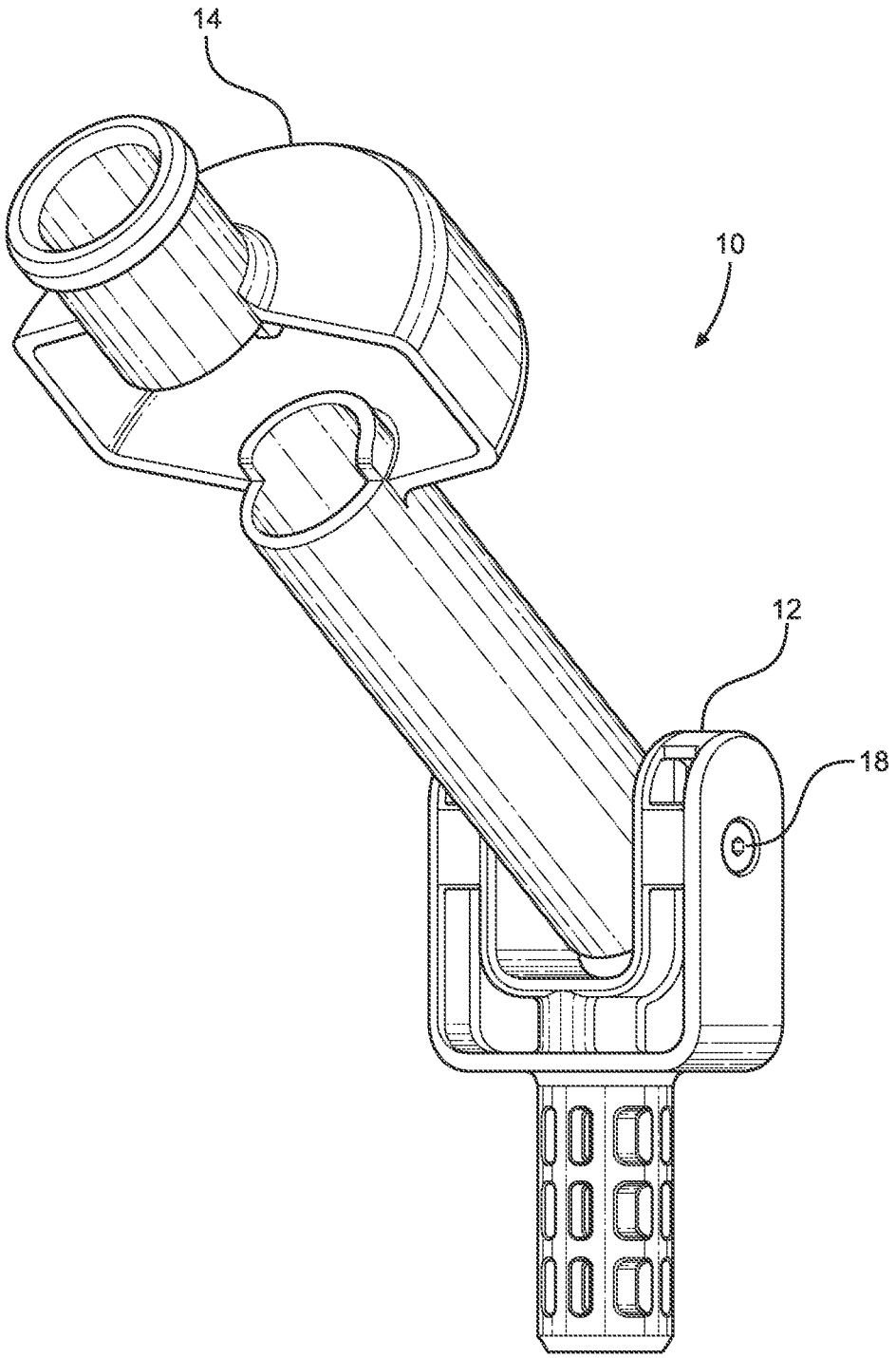
FIG. 3 shows a rear perspective view of one embodiment of the present invention.

By way of example, one embodiment of an exercise device 10 includes a y-shaped yoke 12 joined to a pivotal tubular receiver 14 with a shoulder bolt 16 and a nylon locking nut 18. A detent pin 20 joins a base washer 22 to the y-shaped yoke 12. An exercise device includes a y-shaped yoke joined to a pivotal tubular receiver with a shoulder bolt and a nylon locking nut. A detent pin joins a base washer to the y-shaped yoke. Weights arranged above the base washer 22 are used as a stabilizing support foundation while performing exercise.

In some embodiments, the combination of the detent pin 20 and base washer 22 rest on the floor. Standard barbell weight plates can be lowered down over the detent pin 20 and onto the base washer 22. The base washer 22 is designed to self-align to the weight plates, so the detent pin 20 passes up through the center of the weight plate hole. The y-shaped yoke 12 is then pushed down on the detent pin 20 and is transiently held in place by the detent pin 20 ball against a shelf inside the shaft of the y-shape yoke designed for this purpose. The y-shaped yoke 12 rotates laterally. The connection of the receiver to the y-shaped yoke 12 allows the receiver to rotate vertically. As the y-shaped yoke 12 and the pivotal tubular receiver 14 are bolted together, the exercise device 10 provides a circular motion, a vertical or lateral motion of any combination, which in a weighted scenario aids in the performance of exercises.

Turning to these components in more detail, the pivotal tubular receiver 14 further comprises a shroud joined to a first tube and a second tube into one integral unit. The first tube of the receiver accepts a standard configuration barbell. The shroud is at the user end of the receiver and is used to house the barbell with a locking mechanism and secures the barbell in place while it is used for exercise. The shroud is designed to center and self-align the locking mechanism in place, keeping it from inadvertently unlocking or otherwise releasing the barbell from its locked position, but still allowing it to rotate freely as required.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶6. In particular, any use of "step of" in the claims is not intended to invoke the provision of 35 U.S.C. § 112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. An exercise device, comprising:

a y-shaped yoke comprising:

a shaft;

a first portion and a second portion forming a y-shape of said y-shaped yoke;

a pivotal tubular receiver comprising a shroud joined to a first tube and a second tube in an integral unit;

a shoulder bolt extending through an aperture in the second tube of the pivotal tubular receiver and through an aperture in each of the first portion and second portion of the y-shaped yoke to join the shroud to the y-shaped yoke;

wherein the pivotal tubular receiver is configured to pivot about the shoulder bolt;

a base washer;

a weight plate having an aperture; and a detent pin, extending through the base washer and through said aperture in said weight plate to configure said base washer against the weight plate;

wherein the detent pin detachably attaches to the shaft of the v-shaped yoke; and wherein the y-shaped yoke is configured to rotate within the aperture of said weight plate;

wherein said weight plate is arranged above the base washer and used as a stabilizing support foundation while performing exercise; and wherein the first tube is configured to receive a barbell and whereby the barbell is configured to pivot the pivotal tubular receiver to perform exercise.

2. The exercise device of claim 1, further comprising a locking nut, and wherein the yoke is joined to the receiver by said locking nut configured on the shoulder bolt.

* * * * *